United States Patent [19]

Egli

[11] 4,010,729

[45] Mar. 8, 1977

[54] FIREPLACE FURNACE

[75] Inventor: Glen H. Egli, Stuart Draft, Va.

[73] Assignee: Joglex Corporation, Palmyra, Va.

[22] Filed: Apr. 2, 1975

[21] Appl. No.: 564,273

[52] U.S. Cl. ..... 126/121; 126/164; 237/51

[51] Int. Cl.[2] ..... F24B 7/00

[58] Field of Search ..... 126/120, 121, 164; 237/51; D7/207; 122/375

[56] References Cited

UNITED STATES PATENTS

| | | | |
|---|---|---|---|
| 1,608,745 | 11/1926 | Holbek | 126/121 |
| 2,828,078 | 3/1958 | Snodgrass | 126/121 X |
| 3,001,521 | 9/1961 | Reilly | 126/121 |
| 3,240,206 | 3/1966 | Schutt | 126/121 |
| 3,269,383 | 8/1966 | Maasberg | 126/164 |
| 3,635,211 | 1/1972 | Englert | 126/121 |

FOREIGN PATENTS OR APPLICATIONS

| | | | |
|---|---|---|---|
| 556,543 | 10/1943 | United Kingdom | 126/121 |

*Primary Examiner*—Ronald C. Capossela
*Attorney, Agent, or Firm*—Griffin, Branigan and Butler

[57] ABSTRACT

A forced-air heating fireplace grate comprises inlet- and exhaust-manifold ducts extending from the front to the rear of a fireplace and cross ducts extending between the inlet- and exhaust-manifold ducts across the fireplace. Cool air introduced into an outer end of the inlet-manifold duct, passes through the cross ducts to the exhaust-manifold duct and exits from the fireplace at an outer end of the exhaust-manifold duct. The inlet- and exhaust-manifold ducts, and the cross ducts are spaced to form hot-ash retaining spaces therebetween. Longitudinally extending grilles extend across the bottoms of the hot-ash retaining spaces to retain hot ashes therein. The fireplace grate is unobstructed across the top thereof so that logs of greater width than the grate can be placed upon the grate and includes an angled, vertical support in the front thereof to prevent logs from rolling off the front of the grate. Inlet and exhaust transfer ducts for communicating the grate with room air are reversible to opposite sides of the fireplace grate and their positions toward and away from the fireplace grate are also adjustable to accommodate varying fireplace depths.

20 Claims, 3 Drawing Figures

FIREPLACE FURNACE

BACKGROUND OF THE INVENTION

This invention relates generally to the art of open-fireplace grates, and more particularly to fireplace grates in which air to be heated is circulated.

It has long been recognized that open fireplaces are relatively inefficient with some experts estimating that almost ten times more heat goes up chimneys than fireplaces throw into homes. Forced air fireplace grates have been devised to correct this situation, with some related devices being described in U.S. Pat. Nos. 3,240,206 to Shutt; 2,828,078 to Snodgrass; 1,608,745 to Holbek; 2,359,197 to Brooks; and 3,001,521 to Reilly. Further, similar grates are described in Popular Mechanics, October 1974, pages 154–175; and Dec. 1974, pages 174–176.

For a forced-air heating fireplace grate to be most beneficial it should possess the following characteristics:

1. It should be an efficient log holder;
2. It should be easily installable in a large variety of sizes and shapes of fireplaces;
3. It should be uncomplicated and inexpensive to manufacture;
4. The duct work thereof should form an integral grate so that as few as possible additional support members are required;
5. The inlet and outlet transfer ducts thereof for guiding air to and from the grate should be adjustable so that they can be placed on either side of the fireplace and so that they can be easily made to fit fireplaces of various depths;
6. It should be an efficient heat exchanger so that as much duct work as possible is utilized for transferring heat from hot coals to flowing air;
7. It should be designed so that it allows efficient fire-supporting ventilation but yet holds hot ashes and coals in contact with duct work to optimize heat exchange properties.

None of the forced-air heating fireplace grates described in the above mentioned prior art patents and publications provides all of these characteristics. Thus, it is an object of this invention to provide a forced-air heating fireplace grate which has these characteristics.

SUMMARY

According to one aspect of this invention inlet- and exhaust-manifold ducts extend from front to rear of a fireplace and cross ducts, joining the inlet- and exhaust-manifold ducts, extend from side-to-side of the fireplace. The cross ducts are spaced so that they and the inlet- and exhaust-manifold ducts form elongated hot-ash retaining spaces. Grilles extending longitudinally of the spaces retain hot ashes in the spaces. The ducts are held from the fireplace's floor by means of duct-shaped legs attached to the ducts and extending vertically downwardly therefrom to the floor. Inlet and exit transfer ducts for communicating the duct with room air are reversible from side to side of the fireplace and are adjustable to accomodate various depths of fireplaces. An angled vertical support attached to the front of the grate prevents logs from falling off the front of the grate.

BRIEF DESCRIPTION OF THE DRAWINGS

The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
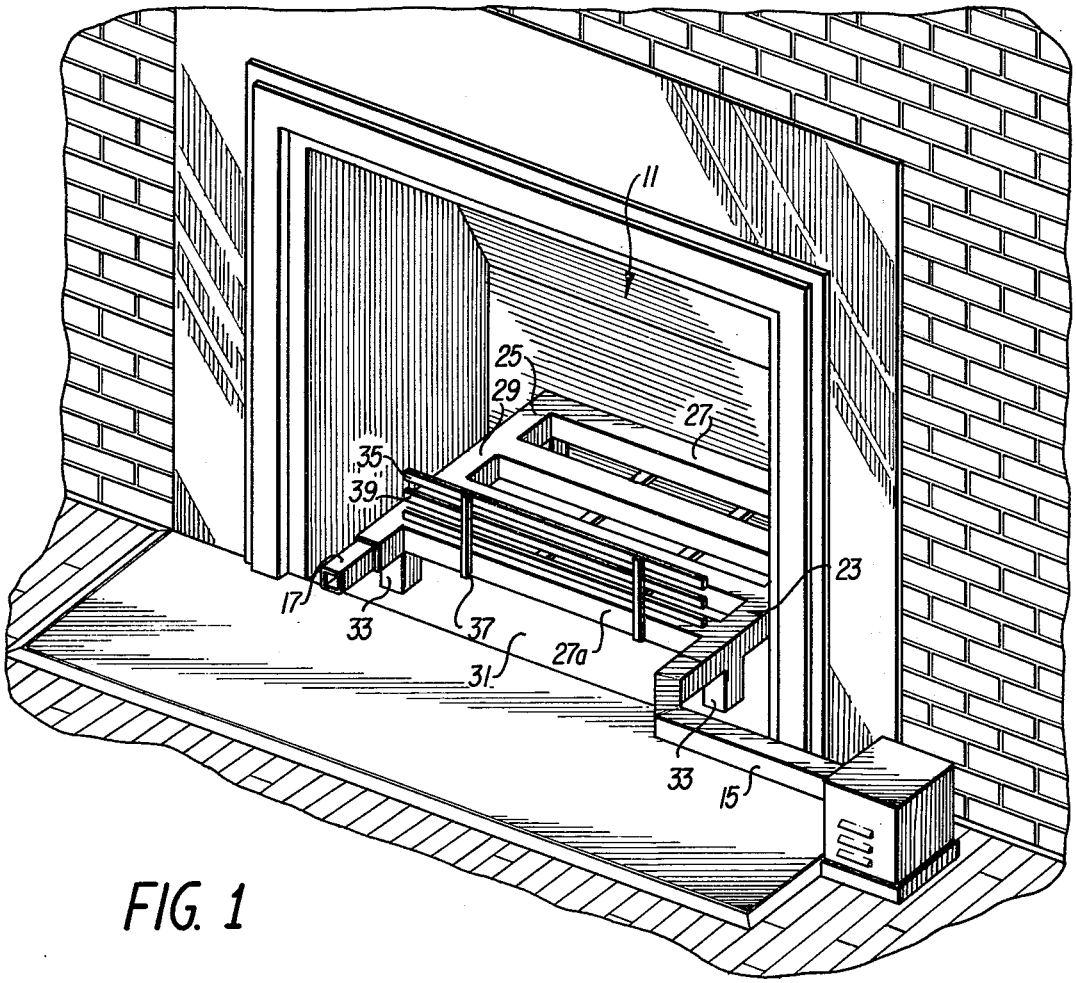
FIG. 1 is an isometric view of a grate of this invention positioned in a fireplace.
Figure 2:
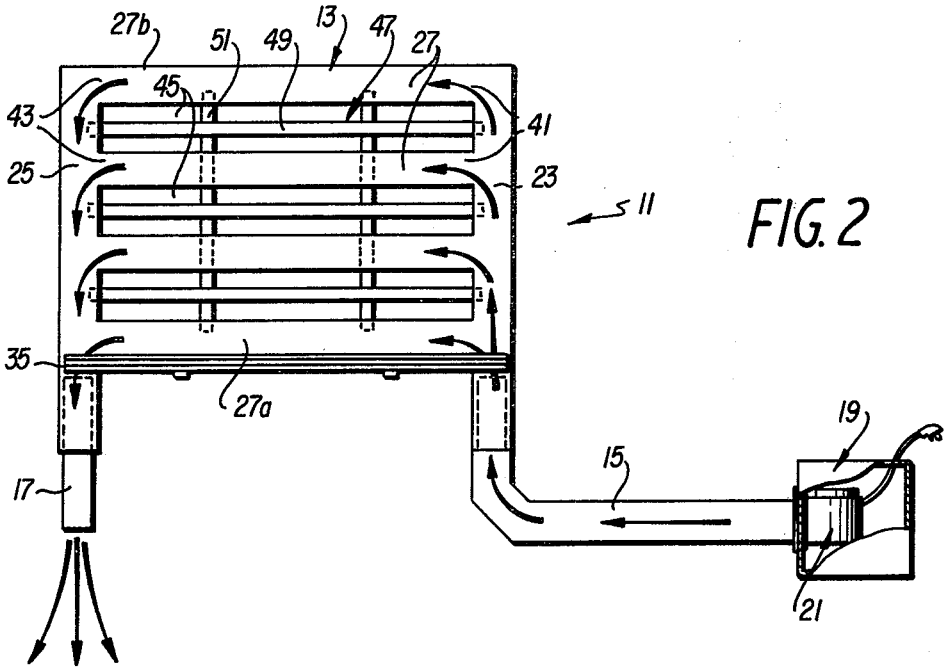
FIG. 2 is a top view of the grate of FIG. 1.

Referring to the drawings, a forced-air heating fireplace grate assembly 11 comprises a grate 13, an inlet transfer duct 15, an exhaust duct 17, a blower case or muffler 19, and a blower 21.

The grate 13 includes inlet- and exhaust-manifold ducts 23 and 25 and cross ducts 27 to form a main log supporting surface 29. The grate 13 is 20 inches in total depth but only 15 inches from the back of the rearmost cross duct **27*b* to the front of the front-most cross duct 27*a*. The grate 13 is 24 inches wide. These ducts are supported a substantial distance from a fireplace floor 31 by duct-shaped legs 33 which are attached directly to the ducts and extend directly vertically downwardly therefrom to the fireplace floor 31. The legs 33 are made of the same stock material as are the manifold and cross ducts 23, 25, and 27, which simplifies construction of the grate by not requiring the use of many diverse types of stock materials. Also these fat, duct-shaped legs provide firm, stable support for the grate 13** and are relatively easy to attach thereto.

Figure 3:
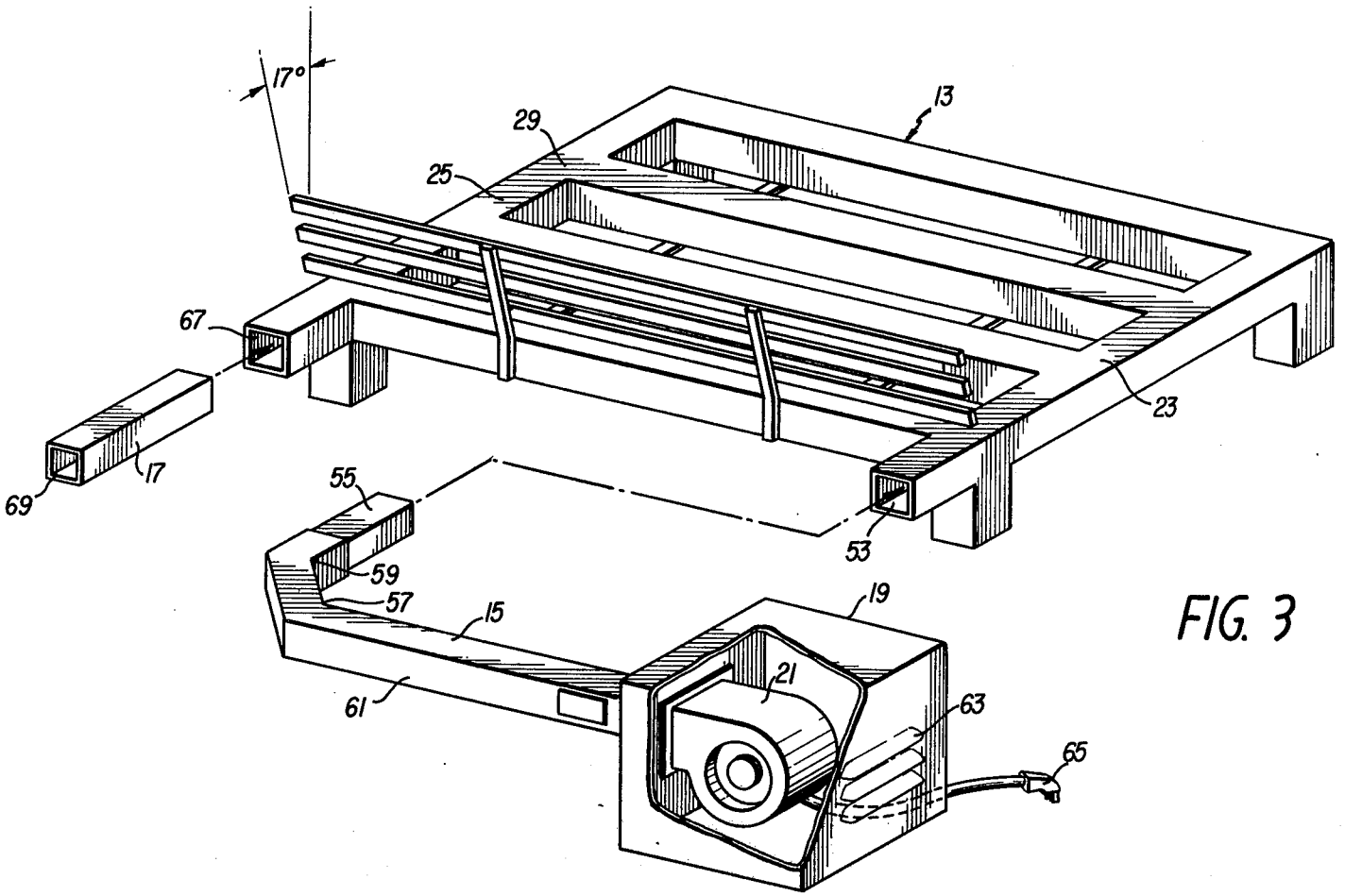
FIG. 3 is an exploded view of the grate of FIG. 1.

A vertical front log support 35 includes vertical bars 37 which are attached directly to the front cross duct **27*a*, and extend upwardly therefrom, and horizontal bars 39 which are attached to the vertical bars 37. It can be seen in FIG. 3 that the vertical bars 37 actually form a 17° angle with the vertical and lean away from the log supporting surface 29 of the grate 13**.

The cross ducts 27 interconnect exit openings 41 of the inlet-manifold duct 23 with inlet openings 43 of the exhaust-manifold duct 25 and are spaced from one another so as to form therebetween, and with the inlet- and exhaust-manifold ducts 23 and 25, hot-ash retaining spaces 45.

A hot-ash retaining grille 47 is welded to the bottom of the inlet- and exhaust-manifold ducts 23 and 25 and the cross ducts 27 and include cross grilles 49 and depth grills 51. In particular, the cross grilles 49 extend longitudinally across the middles of the hot-ash retaining spaces 45 so as to retain large amounts of hot ashes falling from burning material on the log supporting surface 29 in the hot-ash retaining spaces 45 before it drops to the fireplace floor 31. Although the depth grilles 51 also help retain hot ashes, they are intended primarily for support of the cross grilles 49 and do not retain hot ashes to nearly the extent that the cross grilles 49 do.

The inlet transfer duct 15 interconnects an inlet opening 53 (FIG. 3) at the end of the inlet-manifold duct 23 with the blower 21 located in the blower case or muffler 19. The inlet transfer duct 15 has an adaptor section 55 which fits snugly into the inlet opening 53 and is slideable or "telescoping" therein. With such an interconnection, the position of the inlet transfer duct 15 can be adjusted relative to the grate 13 to accomodate various depths of fireplaces while yet providing efficient communication for the transfer of air therebetween.

The inlet transfer duct 15 is bent in two 45° stages 57 and 59 to form a 90° angle between a first portion 61 thereof and the adaptor section 55. This allows the blower 21 to be positioned along a fireplace's face so as to be out of the way, while allowing air to flow smoothly around the 90° curve.

The blower 21 is any type of fan which can be used to direct air along a conduit. The blower 21 and the blower case or muffler 19 are easily removable from the inlet transfer duct 15 and from each other. Vents 63 allow outside air to flow to the blower 21 and a power line 65 furnishes operating energy to the blower 21.

The exhaust transfer duct 17 is sized to fit into an exhaust opening 67 in the end of the exhaust-manifold duct 25. The exhaust transfer duct 17 is slideable in the exhaust-manifold duct 25 so that the position of its outer end 69 is adjustable relative to the grate 13. Again, this enables a user to adjust the outer end 69 to fit various-depth fireplaces.

It should be understood that because of the "telescoping" interconnections between the inlet-manifold duct 23 and the inlet transfer duct 15 and the exhaust-manifold duct 25 and the exhaust transfer duct 17, that the positions of the inlet transfer duct 15 and the exhaust transfer duct 17 can be interchanged. In this case, the element 23 becomes the exhaust-manifold duct and the element 25 becomes the inlet-manifold duct. This adds important flexibility to the use of this grate assembly 11 in that appropriate electrical outlets and/or raised hearths may be more satisfactorily situated on one side of a fireplace than on the other for accomodating the blower 21.

In operation, the grate assembly 11 is situated in a fireplace as depicted in FIG. 1, or with the inlet transfer duct 15 and its associated structure interchanged with the exhaust transfer duct 17. Logs or other flammable materials are placed on the log supporting surface 29 and ignited. As these materials burn, hot ashes fall in the hot-ash retaining spaces 45 and are retained therein by the hot-ash retaining grille 47, and in particular, the cross grilles 49. These hot ashes, and the burning materials transfer large amounts of heat through the cross ducts 27 as well as the inlet- and exhaust-manifold ducts 23 and 25 to air circulated therethrough. Air is blown by the blower 21 through the inlet transfer duct 15 into the inlet-manifold duct 23. From here, this air travels through the exit openings 41 and the cross ducts 27 into the exhaust-manifold duct 25. Throughout this path of travel, the air is gradually and continually heated to a higher temperature. Finally, the air is forced out through the exhaust transfer duct 17. The outer end 69 of the exhaust transfer duct 17 is positioned so that air expelled therefrom travels beyond the outer face of the fireplace and into an adjacent room to heat the room.

It should be noted that the legs 33 are of equal length so that exhaust-manifold duct 25 is parallel with the fireplace floor 31. Thus, air expelled from the exhaust transfer duct 17 is blown out into the room along a horizontal path rather than along an upwardly directed path as in some prior-art grilles. In this regard, it has been found by experimentation that such an arrangement creates more beneficial air flow within the room because it is desireable that air expelled from the grate travel as far as possible prior to rising of its own accord.

Thus, a forced-air heating fireplace grate has been disclosed which provides a good support for logs and combustible material thereon and in which duct work is integrated into a unit with no interconnecting supports other than legs 33 to support the duct work from a fireplace floor. Further, the grate is raised so as to enhance combustion creating air flow but yet the grate is arranged with a hot-ash retaining grill 47 so that hot coals are retained adjacent to the duct work to enhance heat exchanging. The front log support 35 ensures that logs and other burning materials do not fall off the front of the log supporting surface 29 while allowing the exhaust transfer duct 17 to remain parallel with the fireplace floor 31.

This grate is easily portable and can be made to fit almost any size or shape fireplace by reversing various elements thereof.

Further, there is air flow throughout the entire grate system since the grate is actually formed of integrated ducts rather than including bar-shaped inter-supporting members.

The embodiments of the invention in which an exclusive property or privilege are claimed are defined as follows:

1. A forced-air heating fireplace grate for supporting burning materials in a fireplace, said grate comprising:

a single, inlet-manifold duct to extend from front to rear of said fireplace for receiving cool air introduced into said fireplace grate, said single, inlet-manifold duct having an inlet opening for receiving said cool air, and at least three exit openings positioned along the length thereof for releasing air laterally thereof;

a single, exhaust-manifold duct to extend from front to rear of said fireplace for receiving all warm air in said fireplace grate prior to its expulsion from said fireplace grate, said single, exhaust-manifold duct having an exhaust opening positioned at the end thereof so as to be at the front of said fireplace when said grate is positioned in said fireplace and a number of inlet openings corresponding to said exit openings of said inlet-manifold duct positioned along the length thereof for receiving said warm air laterally thereof;

a separate cross duct interconnecting each of said exit openings of said inlet-manifold duct with a respective one of said inlet openings of said exhaust-manifold duct, said cross ducts being approximately equally spaced, one from the other, and extending from side-to-side of said fireplace when said fireplace grate is positioned in said fireplace, said inlet-and exhaust-manifold ducts and said cross ducts thereby defining elongated hot-ash retaining spaces therebetween surrounded by ducts;

legs attached to some of said ducts and extending downwardly from said ducts to support said ducts a substantial distance from the floor of said fireplace;

a single, individual hot-ash retaining cross-grille bar attached directly to said manifold ducts and extending longitudinally of, and across the bottom of each of said hot-ash retaining spaces so as to retain large amounts of hot ashes falling from said burning materials in said hot ash retaining spaces prior to its falling to the floor of said fireplace while allowing efficient fire-supporting ventilation.

2. A forced-air heating fireplace grate as in claim 1 wherein said manifold ducts and said cross ducts have rectangular cross-sectional shapes.

3. A forced-air heating fireplace grate as in claim 1 wherein said legs extend vertically downward from said ducts to which they are attached, to the floor of said fireplace to impinge upon said floor directly beneath the points of attachment with said ducts.

4. A forced-air heating fireplace grate as in claim 1 wherein there are four cross ducts.

5. A forced-air heating fireplace grate as in claim 4 wherein said inlet-and exhaust-manifold ducts and said cross ducts form a combustible-material supporting surface on the top surfaces thereof which is unobstructed at the sides thereof.

6. A forced-air heating fireplace grate as claimed in claim 5 wherein is further included a vertical support extending upwardly from the front of said combustible-material supporting surface to prevent said combustible material from falling forwardly from said surface.

7. A forced-air heating fireplace grate as in claim 4 wherein is further included an inlet transfer duct for furnishing air to said inlet-manifold duct, said inlet transfer duct being reversible between said inlet- and outlet-manifold ducts so that said manifold ducts functions can be thereby reversed.

8. A forced-air heating fireplace grate as in claim 7 wherein the position of the outer end of said inlet transfer duct toward and away from said cross ducts is adjustable.

9. A forced-air heating fireplace grate as in claim 8 wherein is further included an outlet transfer duct for transporting heated air away from said exhaust opening of said exhaust-manifold duct, the position of the outer end of said exhaust transfer duct being adjustable relative to said cross ducts.

10. A forced-air heating fireplace grate as in claim 9 wherein the positions of said inlet and outlet transfer ducts are adjustable by means of a telescoping structure.

11. A forced-air heating fireplace grate as in claim 4 wherein the positions of said inlet and outlet transfer ducts are reversible so that the functions of said inlet- and outlet-manifold ducts can be thereby reversed.

12. A forced-air heating fireplace grate as in claim 11 wherein the positions of said inlet and outlet transfer ducts relative to said cross ducts are adjustable.

13. A forced-air heating fireplace grate as in claim 12 wherein said inlet- and exhaust-manifold ducts and said cross ducts form a combustible-material supporting surface which is unobstructed at the sides thereof.

14. A forced-air heating fireplace grate as in claim 1 wherein is further included a vertical support extending upwardly from said combustible-material supporting surface to prevent said combustible material from falling forwardly from said surface.

15. A forced-air heating fireplace grate as claimed in claim 14 wherein said support is angled toward the front of said fireplace.

16. A forced-air heating fireplace grate as in claim 1 wherein is further included an inlet transfer duct for furnishing air to said inlet-manifold duct, said inlet transfer duct being reversible between said inlet- and outlet-manifold ducts so that said manifold ducts functions can be thereby reversed.

17. A forced-air heating fireplace grate as in claim 16 wherein the position of said inlet transfer duct toward and away from said cross ducts is adjustable.

18. A forced-air heating fireplace grate as in claim 17 wherein the positions of said inlet and outlet transfer ducts are adjustable by means of a telescoping structure.

19. A forced-air heating fireplace grate as in claim 1 wherein is further included an inlet transfer duct for furnishing air to said inlet manifold duct, the position of an inlet transfer duct being reversible so that said functions of said inlet- and outlet-manifold ducts can be thereby reversed.

20. A forced-air heating fireplace grate as in claim 19 wherein is further included as outlet transfer duct for transporting heated air away from said exhaust opening of said exhaust-manifold duct, the position of the outer end of said exhaust transfer duct being adjustable relative to said cross ducts.

* * * * *